US011124884B2

(12) United States Patent
Mohr

(10) Patent No.: US 11,124,884 B2
(45) Date of Patent: Sep. 21, 2021

(54) COMPOSITION FOR REDUCING THE REMOVAL OF MATERIAL BY PICKLING IN THE PICKLING OF METAL SURFACES THAT CONTAIN GALVANIZED AND/OR UNGALVANIZED STEEL

(71) Applicant: Chemetall GmbH, Frankfurt (DE)

(72) Inventor: Anna Verena Mohr, Frankfurt am Main (DE)

(73) Assignee: Chemetall GmbH, Frankfurt (DE)

( * ) Notice: Subject to any disclaimer, the term of this patent is extended or adjusted under 35 U.S.C. 154(b) by 0 days.

(21) Appl. No.: 16/097,134

(22) PCT Filed: Apr. 28, 2017

(86) PCT No.: PCT/EP2017/060227
§ 371 (c)(1),
(2) Date: Oct. 26, 2018

(87) PCT Pub. No.: WO2017/186929
PCT Pub. Date: Nov. 2, 2017

(65) Prior Publication Data

US 2019/0112717 A1 Apr. 18, 2019

(30) Foreign Application Priority Data

Apr. 29, 2016 (DE) ..... 102016207429.6

(51) Int. Cl.

| | |
|---|---|
| ***C23G 1/06*** | (2006.01) |
| ***C23G 1/08*** | (2006.01) |
| ***C23G 1/19*** | (2006.01) |
| ***C23G 1/00*** | (2006.01) |
| ***C23G 1/26*** | (2006.01) |
| ***B08B 3/08*** | (2006.01) |

(52) U.S. Cl.
CPC ..... *C23G 1/065* (2013.01); *B08B 3/08* (2013.01); *C23G 1/00* (2013.01); *C23G 1/06* (2013.01); *C23G 1/061* (2013.01); *C23G 1/068* (2013.01); *C23G 1/081* (2013.01); *C23G 1/19* (2013.01); *C23G 1/26* (2013.01)

(58) Field of Classification Search
CPC ... C23G 1/02; C23G 1/04; C23G 1/06; C23G 1/065; C23G 1/068; C23G 1/08; C23G 1/081; C23G 1/088; C23G 1/00–36; C23F 11/00–188; C23C 22/05; C23C 22/06; C10G 75/02; C11D 3/164; B08B 3/00–14
See application file for complete search history.

(56) References Cited

U.S. PATENT DOCUMENTS

| | | | | |
|---|---|---|---|---|
| 3,310,497 | A | 3/1967 | Hudson et al. | |
| 5,843,373 | A * | 12/1998 | Minevski | C10G 75/02 422/13 |
| 7,531,491 | B2 | 5/2009 | Min et al. | |
| 2005/0163933 | A1* | 7/2005 | Dietsche | B05D 7/142 427/384 |
| 2009/0032057 | A1* | 2/2009 | McCormick | C08G 12/06 134/3 |

FOREIGN PATENT DOCUMENTS

| | | | |
|---|---|---|---|
| DE | 2507059 | A1 | 9/1976 |
| DE | 10345801 | A1 | 4/2005 |
| DE | 102015005521 | A1 | 11/2015 |
| FR | 1475895 | A | 4/1967 |
| FR | 2158664 | A5 | 6/1973 |
| WO | WO-2010/055160 | A2 | 5/2010 |
| WO | WO-2017/186931 | A1 | 11/2017 |
| WO | WO-2017/202891 | A1 | 11/2017 |

OTHER PUBLICATIONS

Wikipedia, "Ethoxylation" (2015), retrieved from https://web.archive.org (Year: 2015).*
International Search Report for International Application No. PCT/EP2017/060227, dated Aug. 11, 2017, 3 pages.

* cited by examiner

*Primary Examiner* — Mikhail Kornakov
*Assistant Examiner* — Richard Z. Zhang
(74) *Attorney, Agent, or Firm* — Armstrong Teasdale LLP

(57) ABSTRACT

An aqueous composition for reducing corrosive removal of material in pickling of metallic surfaces comprising bare and/or galvanized steel. The composition includes a mixture of a compound of the formula $R^1O—(CH_2)_x—C{\equiv}C—(CH_2)_y—OR^2$ in which $R^1$ and $R^2$ are both H, and a compound of the formula $R^1O—(CH_2)_x—C{\equiv}C—(CH_2)_y—OR^2$ in which $R^1$ and $R^2$ are each, independently of one another, an $HO—(CH_2)_w—$ group with w≥2. X and y are each, independently of one another, from 1 to 4 in each of the two compounds of the formula $R^1O—(CH_2)_x—C{\equiv}C—(CH_2)_y—OR^2$. A process for pickling a metallic surface with reduced corrosive removal of material is disclosed.

16 Claims, No Drawings

COMPOSITION FOR REDUCING THE REMOVAL OF MATERIAL BY PICKLING IN THE PICKLING OF METAL SURFACES THAT CONTAIN GALVANIZED AND/OR UNGALVANIZED STEEL

CROSS-REFERENCE TO RELATED APPLICATIONS

This application is a U.S. National Phase Application of PCT/EP2017/060227, filed Apr. 28, 2017, which claims the benefit of priority to DE Application No. 102016207429.6, filed Apr. 29, 2016, the contents of which are hereby expressly incorporated by reference in their entirety.

The invention relates to an aqueous composition for reducing the corrosive removal of material in the pickling of metallic surfaces comprising bare and/or galvanized steel and also a process for pickling a corresponding metallic surface with reduced corrosive removal of material.

Due to atmospheric corrosion or in the heat treatment (e.g. heat generated during forming or welding) of iron and steel, scale and rust layers are formed on the metal surface. For the purposes of the present invention, pickling is the dissolution of these oxide layers in mineral acid solutions in order to obtain a metallically clean surface for further processing.

This serves mainly to remove oxide films composed of rust (FeO, $Fe_2O_3$, $Fe_3O_4$ and iron oxide hydrates) or zinc oxide from the surface, which in turn increases the strength of adhesion and uniformity of subsequent coatings, in particular a conversion coating, on the surface.

However, a problem here is that excessive corrosive attack not only removes the oxide film from the surface but also attacks the metallic surface itself, so that iron(II), iron(III) ions or zinc ions go into solution as a result of oxidation in the presence of protons (anodic metal dissolution). In other words: corrosive removal of material from the metallic surface occurs.

For example, the following reactions proceed in the pickling of a steel surface by means of a solution comprising sulfuric acid:

$$FeO+H_2SO_4 \rightarrow FeSO_4+H_2O \quad (1)$$

$$Fe_3O_4+4H_2SO_4 \rightarrow Fe_2(SO_4)_3+FeSO_4+4H_2O \quad (2)$$

$$Fe_2O_3+3H_2SO_4 \rightarrow Fe_2(SO_4)_3+3H_2O \quad (3)$$

$$Fe+H_2SO_4 \rightarrow FeSO_4+2H. \text{ (briefly at the metal surface)} \quad (4)$$

$$Fe+H_2SO_4 \rightarrow FeSO_4+H_2\uparrow \quad (5)$$

The atomic hydrogen (H.) formed according to equation (4) is preferably absorbed on the iron, penetrates into the crystal lattice and there combines to form hydrogen molecules ($H_2$). The pressures caused by the hydrogen gas impair the mechanical properties of the metal. The term "hydrogen embrittlement" is also used. This embrittlement is irreversible and can lead to cracks or pickling bubbles. The amount of hydrogen formed during corrosive removal of material is decisive for the degree of embrittlement.

Cracks and pickling bubbles arising from excessive corrosive removal of material and especially the hydrogen embrittlement caused by corrosive removal of material gives the metallic surface a nonuniform morphology, which is carried over to subsequent coatings so that these also have a certain nonuniformity. This in turn leads to a reduction in the strength of adhesion of the coatings and in the corrosion protection produced by these.

Various compounds, for example alkyne alkoxylates or thiodiglycolate alkoxylates, which act as corrosion inhibitors, i.e. reduce the corrosive removal of material, are known from the prior art.

As regards the quality of subsequent conversion treatments, it has been found that the use of corrosion inhibitors which have an inhibition index (=reduction in the corrosive removal of material based on corresponding pickling without corrosion inhibitor) of more than 95 percent is desirable, and the abovementioned corrosion inhibitors of the prior art do not have such high values.

Only N,N'-diethylthiourea and mixtures of N,N'-di(o-tolyl)thiourea, N,N'-dibutylthiourea and hexamethylenetetramine give satisfactory results due to an inhibition index of in each case 96 percent.

However, the use of N,N'-diethylthiourea is increasingly undesirable since it is very problematical from toxicological and also environmental points of view.

The use of a mixture of N,N'-di(o-tolyl)thiourea, N,N'-dibutylthiourea and hexamethylenetetramine, on the other hand, is no longer possible at all because of the REACH regulations (European regulations for "Registration, Evaluation, Authorisation and Restriction of Chemicals").

It was therefore an object of the invention to provide a composition for reducing the corrosive removal of material in the pickling of metallic surfaces comprising bare and/or galvanized steel and also a process for pickling a corresponding metallic surface with reduced corrosive removal of material which is in each case completely compatible with a subsequent conversion treatment and is less toxicologically problematical and less environmentally harmful.

In the case of carrying over, i.e. incomplete removal of the composition, the formation of the conversion coating should preferably also not be adversely affected and a water-wettable surface should be made available.

Furthermore, the operating life of a corresponding pickling bath should preferably be increased as a result of the reduced corrosive removal of material.

This object is achieved by a composition according to claim 1, a concentrate according to claim 7, a process according to claim 8 and a use according to claim 15. Advantageous embodiments are in each case described in the dependent claims.

The aqueous composition of the invention for reducing the corrosive removal of material in the pickling of metallic surfaces comprising bare and/or galvanized steel comprises a mixture of a compound of the formula I $$R^1O—(CH_2)_x—C{\equiv}C—(CH_2)_y—OR^2 \quad (I),$$

in which $R^1$ and $R^2$ are both H and a compound of the formula I in which $R^1$ and $R^2$ are each, independently of one another, an $HO—(CH_2)_w—$ group with $w \geq 2$, where x and y are each, independently of one another, from 1 to 4 in each of the two compounds of the formula I.

Definitions:

For the present purposes, an "aqueous composition" is a composition which comprises predominantly, i.e. to an extent of more than 50% by weight, water as solvent/dispersion medium. The aqueous composition is preferably a solution, more preferably a solution comprising only water as solvent.

The "galvanized steel" can in the present case be either electrolytically galvanized steel or hot-galvanized steel.

Compounds of the formula I act as physical corrosion inhibitors which are adsorbed by van der Waals forces on the metallic surface, as a result of which a monomolecular, homogeneous, densely packed layer is formed on this surface. Said layer at least partially physically shields the metallic surface from protonic attack and the corrosive removal of material from the surface is thus prevented or at least reduced.

It has surprisingly been found that a significant synergistic effect for reducing the corrosive removal of material can be achieved by use of particular mixtures of different compounds of the formula I.

The aqueous composition of the invention is substantially free of N,N'-diethylthiourea, N,N'-di(o-tolyl)thiourea, N,N'-dibutylthiourea and hexamethylenetetraamine.

Here, "substantially free" means that the abovementioned compounds have not been deliberately added to the composition, i.e. they are at most impurities in the starting materials used. The total content of these compounds in the composition of the invention is preferably below 5 mg/l, more preferably below 1 mg/l.

The mixing ratio in % by weight of the compound of the formula I in which $R^1$ and $R^2$ are both hydrogen and the compound of the formula I in which $R^1$ and $R^2$ are each, independently of one another, an $HO—(CH_2)_w—$ group with $w \geq 2$ is preferably in the range from 0.5:1 to 2:1, particularly preferably in the range from 0.75:1 to 1.75:1 and very particularly preferably in the range from 1:1 to 1.5:1 (calculated as 2-butyne-1,4-diol and 2-butyne-1,4-diol bis(2-hydroxyethyl)ether).

The sum of x and y is preferably from 2 to 5 in each of the two compounds of the formula I.

The aqueous composition more preferably comprises a mixture of 2-butyne-1,4-diol and 2-butyne-1,4-diol bis(2-hydroxyethyl)ether.

In this case, the mixing ratio in % by weight is once again preferably in the range from 0.5:1 to 2:1, particularly preferably in the range from 0.75:1 to 1.75:1 and very particularly preferably in the range from 1:1 to 1.5:1.

In a preferred embodiment, the composition additionally comprises at least one compound of the formula II $$R^1O—(CH_2)_x—S—(CH_2)_y—OR^2 \quad \text{(II)},$$

where $R^1$ and $R^2$ are each, independently of one another, H or an $HO—(CH_2)_w—$ group with $w \geq 2$ and x and y are each, independently of one another, from 1 to 4.

The at least one compound of the formula II is preferably $HO—CH_2—S—CH_2—OH$.

The aqueous composition of the invention is obtainable from the concentrate of the invention by dilution with a suitable solvent and/or dispersion medium, preferably with water, and optionally adjustment of the pH.

The dilution factor in the addition of the concentrate to the pickling solution in step ii) (see below) is preferably in the range from 1:23 to 1:225.

The dilution factor in the addition of the concentrate to the rinsing solution in step iii) (see below) on the other hand is preferably in the range from 1:225 to 1:2250.

In the process of the invention for pickling a metallic surface comprising bare and/or galvanized steel, the surface is, in successive process steps i) optionally cleaned and/or rinsed, ii) brought into contact with an aqueous pickling composition and iii) brought into contact with an aqueous rinsing composition, where the pickling composition in step ii) and/or the rinsing composition in step iii) is at least one composition according to the invention as described above.

The optional cleaning in step i) is preferably carried out using an alkaline cleaning solution, particularly preferably having a pH of 9.5 or more.

The pickling composition ii) preferably comprises at least one compound selected from the group consisting of phosphonates, condensed phosphates and citrate and/or comprises at least one mineral acid selected from the group consisting of sulfuric acid, hydrochloric acid, hydrofluoric acid and nitric acid; it particularly preferably comprises at least one mineral acid selected from the group consisting of sulfuric acid, hydrochloric acid, hydrofluoric acid and nitric acid and very particularly preferably comprises sulfuric acid.

The pH of the rinsing composition in step iii) is preferably strongly acidic, neutral or weakly alkaline; it is particularly preferably in the range from 2 to 8.

In a first preferred embodiment, the pickling composition in step ii) is a composition according to the invention as described above.

In this case, the total concentration of the mixture of the two compounds of the formula I in the pickling composition is preferably in the range from 31 to 620 mg/l, particularly preferably in the range from 31 to 310 mg/l (calculated as 2-butyne-1,4-diol).

The use of the mixture of the two compounds of the formula I in the pickling composition has the advantage of reducing the corrosive removal of material particularly effectively.

In a second preferred embodiment, the rinsing composition in step iii) is a composition according to the invention as described above.

In this case, the total concentration of the mixture of the two compounds of the formula I in the rinsing composition is preferably in the range from 3 to 62 mg/l, particularly preferably in the range from 3 to 31 mg/l (calculated as 2-butyne-1,4-diol).

During rinsing of the previously pickled metallic surface, mineral acid from the liquid film adhering to the surface is still present, so that corrosive attack is continued, even though to a reduced degree. This results in formation of a rust film. The use of the mixture of the two compounds of the formula I in the rinsing composition has the advantage of reducing this rust film formation.

In a third preferred embodiment, the pickling composition in step ii) and the rinsing composition in step iii) are each a composition according to the invention as described above. The mixture of the two compounds of the formula I in the pickling composition and that in the rinsing composition can be the same mixture or different mixtures.

In this embodiment, the total concentration of the mixture of the two compounds of the formula I in the pickling composition is once again preferably in the range from 31 to 620 mg/l, particularly preferably in the range from 31 to 310 mg/l (calculated as 2-butyne-1,4-diol), and that in the rinsing composition is preferably in the range from 3 to 62 mg/l, particularly preferably in the range from 3 to 31 mg/l (calculated as 2-butyne-1,4-diol).

The metallic surface comprising bare and/or galvanized steel which is pickled by means of the process of the invention is preferably the surface of a metallic component/workpiece, for example a steel tube, of wires or screws (small items).

The metallic surface pickled by means of the process of the invention is therefore preferably used in the field of the treatment of parts.

The pickled and rinsed metallic surface is preferably firstly conversion-treated. An acidic aqueous composition comprising zinc phosphate, manganese phosphate and optionally nickel ions is preferably used for the conversion treatment (known as zinc phosphating).

However, it is also possible to carry out thin film coating by means of an acidic aqueous composition comprising a titanium, zirconium and/or hafnium compound and optionally copper ions and/or a compound which liberates copper ions, optionally a polymer and/or copolymer and optionally an organoalkoxysilane and/or a hydrolysis and/or a condensation product thereof.

The optionally rinsed metallic surface is then surface-coated. Preference is given to firstly applying a primer coating which is particularly preferably a CEC (cathodic electrophoretic coating), particularly preferably a (meth) acrylate- or epoxide-based CEC, and subsequently applying a topcoat.

In the field of cold forming, on the other hand, a lubricant comprising salts, polymers and/or soaps is applied to the pickled and rinsed metallic surface.

The present invention is illustrated by the following, nonlimiting examples.

EXAMPLES

Aqueous pickling solutions A to E each comprising 20% by weight of $H_2SO_4$, 50 g/l of $Fe^{2+}$ and optionally one or two corrosion inhibitors were made up.

The composition of the solutions is shown in Tab. 1 below:

TABLE 1

| Pickling solution | Corrosion inhibitor(s) | Content of corrosion inhibitor(s) |
|---|---|---|
| A | — | — |
| B | N,N'-diethylthiourea | 150 mg/l |
| C | N,N'-di(o-toly)thiourea + N,N'-dibutylthiourea + hexamethylenetetraamine | total of 100 mg/l |
| D | but-2-yne-1,4-diol | 100 mg/l |
| E | 2-butyne-1,4-diol bis(2-hydroxyethyl) ether | 50 mg/l |
| F | but-2-yne-1,4-diol + 2-butyne-1,4-diol bis(2-hydroxyethyl) ether) | 50 mg/l and 25 mg/l |

Test plates made of CRS (cold-rolled steel) were in each case weighed before treatment with one of the pickling solutions.

Three plates in each case were then immersed for 5 minutes in a bath comprising one of the pickling solutions B to F (with corrosion inhibitor(s)) and one plate was immersed for the same time in a bath comprising pickling solution A (without corrosion inhibitor). The baths had a temperature of 60° C. The plates were rotated at a speed of 400 rpm.

All plates were subsequently rinsed with deionized water, dried and weighed. The weight loss caused by the treatment with pickling solution in each case represents the corrosive removal of material.

For each of the sets of three plates which had been treated with one of the pickling solutions B to F, the average of the corrosive removal of material was in each case calculated and this was divided by the value for the one plate treated with pickling solution A. The result in percent was subtracted from 100 percent and the respective inhibition index of the corrosion inhibitors(s) was thus determined (see Tab. 2 below).

TABLE 2

| Pickling solution | Inhibition index |
|---|---|
| A | 0% |
| B | 96% |
| C | 96% |
| D | 85% |
| E | 92% |
| F | 97% |

The corrosion inhibitors of the pickling solutions B and C, which are to be avoided from both toxicological and environmental points of view, thus each displayed an excellent inhibition index of 96%. The inhibition indices of the individual inhibitors but-2-yne-1,4-diol (pickling solution D) and 2-butyne-1,4-diol bis(2-hydroxyethyl) ether (pickling solution E) remain significantly behind at 85% and 92%, respectively. The inhibition index of the mixture according to the invention of the two latter corrosion inhibitors (pickling solution F) was, however, surprisingly high at 97% and was even superior to the abovementioned corrosion inhibitors which are to be avoided.

The plates were then additionally zinc phosphated. The pickling solutions B and F were added in increasing amounts to the phosphating bath. The appearance of the plates was firstly evaluated. Secondly, the layer weight in g/m$^2$ calculated as $P_2O_5$ were determined by means of XRF analysis.

The results for the pickling solutions B according to the prior art, comprising various amounts of N,N'-diethylthiourea, are reported in Tab. 3 and those for the pickling solutions F according to the invention, comprising various amounts of the mixture of but-2-yne-1,4-diol and 2-butyne-1,4-diol bis(2-hydroxyethyl) ether, are reported in Tab. 4.

TABLE 3

| Content of corrosion inhibitor | Appearance of the plates (school grades of 1 = very good to 6 = unsatisfactory) | Layer weight in g/m$^2$ (calculated as $P_2O_5$) |
|---|---|---|
| — | 1 | 2.864 |
| 10 mg/l | 5 | 2.272 |
| 25 mg/l | 6+ | 0.320 |
| 100 mg/l | 6 | 0.144 |
| 200 mg/l | 6 | 0.192 |

TABLE 4

| Content of corrosion inhibitors | Appearance of the plates (school grades of 1 = very good to 6 = unsatisfactory) | Layer weight in g/m$^2$ (calculated as $P_2O_5$) |
|---|---|---|
| — | 1 | 3.264 |
| 25 and 12.5 mg/l | 2 | 3.264 |
| 50 and 25 mg/l | 2– | 3.264 |
| 100 and 50 mg/l | 4-5 | 3.008 |

It can thus clearly be seen from Tab. 3 that a dramatic decrease in the layer thickness and thus an ever more unsatisfactory formation of the phosphate layer occurs on steel with an increasing content of N,N'-diethylthiourea.

As can be seen from Tab. 4, only a significantly higher content of but-2-yne-1,4-diol and 2-butyne-1,4-diol bis(2-hydroxyethyl) ether has, in comparison, a significant adverse effect on the layer formation.

Accordingly, the mixture of the invention not only reduces the corrosive removal of material but also leads to no interference in the layer formation, for example as a result of carrying-over of the pickling solution, in a subsequent phosphating step.

The invention claimed is:

1. An aqueous composition for reducing corrosive removal of material in pickling of metallic surfaces comprising bare and/or galvanized steel, wherein the composition comprises a mixture of a compound of formula I $$R^1O—(CH_2)_x—C≡C—(CH_2)_y—OR^2 \quad (I),$$

in which $R^1$ and $R^2$ are both H and a compound of the formula I in which $R^1$ and $R^2$ are each, independently of one another, an HO—$(CH_2)_w$— group with w≥2, wherein x and y are each, independently of one another, from 1 to 4 in each of the two compounds of the formula I, wherein a mixing ratio in % by weight of the compound of the formula I in which $R^1$ and $R^2$ are both H and the compound of the formula I in which $R^1$ and $R^2$ are each, independently of one another an HO—$(CH_2)_w$— group with w≥2 is in a range from 0.5:1 to 2:1 (calculated as 2-butyne-1,4-diol and 2-butyne-1,4-diol bis(2-hydroxyethyl) ether), wherein the composition additionally comprises at least one compound of formula II $$R^1O—(CH_2)_x—S—(CH_2)_y—OR^2 \quad (II),$$

in which $R^1$ and $R^2$ are each, independently of one another, an HO—$(CH_2)_w$— grows with w≥2 and x and y are each, independently of one another, from 1 to 4.

2. The composition according to claim 1, wherein a sum of x and y is from 2 to 5 in each of the two compounds of the formula I.

3. The composition according to claim 2, wherein the composition comprises a mixture of 2 butyne-1,4-diol and 2-butyne-1,4-diol bis(2-hydroxyethyl) ether.

4. A concentrate from which a composition according to claim 1 is obtainable by dilution with a suitable solvent and/or dispersion medium and optionally a pH adjustment.

5. A process for pickling a metallic surface comprising bare and/or galvanized steel, wherein the surface is, in successive process steps i) optionally cleaned and/or rinsed, ii) brought into contact with an aqueous pickling composition and iii) brought into contact with an aqueous rinsing composition, where the pickling composition in step ii) and/or the rinsing composition in step iii) is a composition according to claim 1.

6. The process according to claim 5, wherein the pickling composition in step ii) is a composition comprising a mixture of a compound of formula I $$R^1O—(CH_2)_x—C≡C—(CH_2)_y—OR^2 \quad (I),$$

in which $R^1$ and $R^2$ are both H and a compound of the formula I in which $R^1$ and $R^2$ are each, independently of one another, an HO—$(CH_2)_w$— group with w≥2, where x and y are each, independently of one another, from 1 to 4 in each of the two compounds of the formula I, wherein a mixing ratio in % by weight of the compound of the formula I in which $R^1$ and $R^2$ are both H and the compound of the formula I in which $R^1$ and $R^2$ are each, independently of one another an HO—$(CH_2)_w$— group with w≥2 is in a range from 0.5:1 to 2:1 (calculated as 2-butyne-1,4-diol and 2-butyne-1,4-diol bis(2-hydroxyethyl) ether), wherein the composition additionally comprises at least one compound of formula II $$R^1O—(CH_2)_x—S—(CH_2)_y—OR^2 \quad (II),$$

in which $R^1$ and $R^2$ are each, independently of one another, an HO—$(CH_2)_w$— group with w≥2 and x and y are each, independently of one another, from 1 to 4.

7. The process according to claim 6, wherein a total concentration of the two compounds of the formula I is in a range from 31 to 620 mg/l (calculated as 2-butyne-1,4-diol).

8. The process according to claim 5, wherein the rinsing composition in step iii) is a composition comprising a mixture of a compound of formula I $$R^1O—(CH_2)_x—C≡C—(CH_2)_y—OR^2 \quad (I),$$

in which $R^1$ and $R^2$ are both H and a compound of the formula I in which $R^1$ and $R^2$ are each, independently of one another, an HO—$(CH_2)_w$— group with w≥2, where x and y are each, independently of one another, from 1 to 4 in each of the two compounds of the formula I, wherein a mixing ratio in % by weight of the compound of the formula I in which $R^1$ and $R^2$ are both H and the compound of the formula I in which $R^1$ and $R^2$ are each, independently of one another an HO—$(CH_2)_w$— group with w≥2 is in a range from 0.5:1 to 2:1 (calculated as 2-butyne-1,4-diol and 2-butyne-1,4-diol bis(2-hydroxyethyl) ether), wherein the composition additionally comprises at least one compound of formula II $$R^1O—(CH_2)_x—S—(CH_2)_y—OR^2 \quad (II),$$

in which $R^1$ and $R^2$ are each, independently of one another, an HO—$(CH_2)_w$— group with w≥2 and x and y are each, independently of one another, from 1 to 4.

9. The process according to claim 8, wherein a total concentration of the two compounds of the formula I is in a range from 3 to 62 mg/l (calculated as 2-butyne-1,4-diol).

10. The process according to claim 8, wherein the pickling composition in step ii) comprises sulfuric acid.

11. The process according to claim 5, wherein a pH of the rinsing composition in step iii) is in a range from 2 to 8.

12. The use of a metallic surface pickled by means of the process according to claim 5 in a field of treatment of parts.

13. The composition according to claim 1, wherein the mixing ratio in % by weight of the compound of the formula I in which $R^1$ and $R^2$ are both H and the compound of the formula I in which $R^1$ and $R^2$ are each, independently of one another an HO—$(CH_2)_w$— group with w≥2 is in a range from 0.75:1 to 1.75:1 (calculated as 2-butyne-1,4-diol and 2-butyne-1,4-diol bis(2-hydroxyethyl) ether).

14. The composition according to claim 13, wherein the mixing ratio in % by weight of the compound of the formula I in which $R^1$ and $R^2$ are both H and the compound of the formula I in which $R^1$ and $R^2$ are each, independently of one another an HO—$(CH_2)_w$— group with w≥2 is in a range from 1:1 to 1.5:1 (calculated as 2-butyne-1,4-diol and 2-butyne-1,4-diol bis(2-hydroxyethyl) ether).

15. The process according to claim 7, wherein the total concentration of the two compounds of the formula I is in a range from 31 to 310 mg/l (calculated as 2-butyne-1,4-diol).

16. The process according to claim 9, wherein the total concentration of the two compounds of the formula I is in a range from 3 to 31 mg/l (calculated as 2-butyne-1,4-diol).

* * * * *